US010571841B2

(12) United States Patent
Fujita et al.

(10) Patent No.: US 10,571,841 B2
(45) Date of Patent: Feb. 25, 2020

(54) THICKNESS DETECTOR AND IMAGE FORMING APPARATUS

(71) Applicants: Hayato Fujita, Kanagawa (JP); Keita Maejima, Kanagawa (JP); Hiroshi Okamura, Kanagawa (JP); Masaki Tsugawa, Kanagawa (JP); Yuji Ikeda, Kanagawa (JP); Yohei Kushida, Kanagawa (JP); Emiko Kawarasaki, Tochigi (JP)

(72) Inventors: Hayato Fujita, Kanagawa (JP); Keita Maejima, Kanagawa (JP); Hiroshi Okamura, Kanagawa (JP); Masaki Tsugawa, Kanagawa (JP); Yuji Ikeda, Kanagawa (JP); Yohei Kushida, Kanagawa (JP); Emiko Kawarasaki, Tochigi (JP)

(73) Assignee: Ricoh Company, Ltd., Tokyo (JP)

( * ) Notice: Subject to any disclaimer, the term of this patent is extended or adjusted under 35 U.S.C. 154(b) by 225 days.

(21) Appl. No.: 15/854,293

(22) Filed: Dec. 26, 2017

(65) Prior Publication Data

US 2018/0239285 A1 Aug. 23, 2018

(30) Foreign Application Priority Data

Feb. 17, 2017 (JP) ..... 2017-028391

(51) Int. Cl.
*G03G 15/00* (2006.01)
*B65H 7/02* (2006.01)

(52) U.S. Cl.
CPC ..... *G03G 15/5029* (2013.01); *B65H 7/02* (2013.01); *G03G 15/6594* (2013.01)

(58) Field of Classification Search
CPC ... G03G 15/5029; G03G 15/6594; B65H 7/02
See application file for complete search history.

(56) References Cited

U.S. PATENT DOCUMENTS 6,276,266 B1 * 8/2001 Dietz ..... B41F 17/001 101/41
8,365,663 B2 * 2/2013 Kim ..... B41F 9/01 101/154

(Continued)

FOREIGN PATENT DOCUMENTS

JP 2013-227120 11/2013

*Primary Examiner* — David H Banh
(74) *Attorney, Agent, or Firm* — Harness, Dickey & Pierce, P.L.C.

(57) ABSTRACT

A thickness detector includes a rotator having different shape marks, disposed at different positions in a rotation direction; an opposing member disposed opposite the rotator; a detector to detect and output a displacement amount of the rotator or the opposing member in a sheet thickness direction; and a controller. The controller is configured to acquire first output values for one rotation from the detector, in a state without sheet; determine, based on a value output from the detector, whether one of the plurality of marks is detected in a state with the sheet held; acquire a predetermined number of second output values after one of the marks is detected; extract, from the first output values, values corresponding to the second output values, based on the value corresponding to the detected mark; and calculate a sheet thickness based on the second output values and the extracted first output values.

8 Claims, 10 Drawing Sheets

(56) References Cited

U.S. PATENT DOCUMENTS

| | | | | |
|---|---|---|---|---|
| 9,713,268 | B2 * | 7/2017 | Hirano | H05K 3/1275 |
| 2004/0123753 | A1 * | 7/2004 | Yoo | B41M 1/10 101/158 |
| 2008/0184904 | A1 * | 8/2008 | Yoo | B41F 13/193 101/450.1 |
| 2010/0147168 | A1 * | 6/2010 | Puschel | B41F 13/193 101/217 |
| 2015/0217560 | A1 * | 8/2015 | Sakamoto | B41N 10/02 101/217 |
| 2015/0352829 | A1 * | 12/2015 | Sente | B41M 1/10 101/153 |

* cited by examiner

THICKNESS DETECTOR AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-028391, filed on Feb. 17, 2017, in the Japan Patent Office, the entire disclosure of which is hereby incorporated by reference herein.

BACKGROUND

Technical Field

This disclosure generally relates to a thickness detector and an apparatus including the thickness detector, such as an image forming apparatus.

Description of the Related Art

There are electrophotographic image forming apparatuses that perform control operation in accordance with a thickness of a sheet fed thereinto, to preferably transfer an image to the sheet and fix the image thereon.

For example, a sheet thickness can be detected using a roller pair disposed in a sheet conveyance path. In this method, to detect the sheet thickness, a displacement of the roller of the roller pair between a state in which the sheet is not held in the roller pair and a state in which the sheet is held in the roller pair is measured.

Rollers disposed along the conveyance path are preferably free of eccentric. That is, preferably, the distance from the axis of rotation of the roller to the circumferential face of the roller that contacts the sheet is constant. However, assembling errors and changes of components with elapse of time cause eccentricity in the distance from the axis of rotation to the circumferential face of the roller, and rotation of the roller includes an eccentricity component. In the above-described measurement of the displacement of the roller, the eccentricity component is a noise to hinder precise measurement of the sheet thickness.

SUMMARY

According to an embodiment of this disclosure, a thickness detector includes a roller assembly, a detector to detect and output an amount of displacement of the roller assembly, and a controller. The roller assembly includes a rotator having a plurality of marks different in shape and disposed at different positions on a face of the rotator in a direction of rotation of the rotator, and an opposing member disposed opposite the rotator, to convey a sheet held in the roller assembly together with the rotator. The detector is configured to detect and output an amount of displacement of one of the rotator and the opposing member in a direction of thickness of the sheet. The controller includes a first acquisition unit configured to acquire first output values for one rotation of the rotator from the detector, and the first output values are output in a state in which the sheet is not held in the roller assembly. The controller further includes a determining unit configured to determine, based on a value output from the detector, whether the detector has detected one of the plurality of marks of the rotator in a state in which the sheet is held in the roller assembly; a second acquisition unit configured to acquire, from the detector, a predetermined number of second output values output after detection of the one of the plurality of marks; and a calculation unit configured to extract, from the first output values for one rotation of the rotator, output values corresponding to the predetermined number of second output values acquired by the second acquisition unit, based on the value output corresponding to detection of the one of the plurality of marks. The calculation unit is further configured to calculate a thickness of the sheet based on the second output values and the extracted first output values.

In another embodiment, an image forming apparatus includes an image forming device to form an image on a sheet, and the above-described thickness detector. In the image forming apparatus, the roller assembly of the thickness detector is disposed upstream from the image forming device in a direction of conveyance of the sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
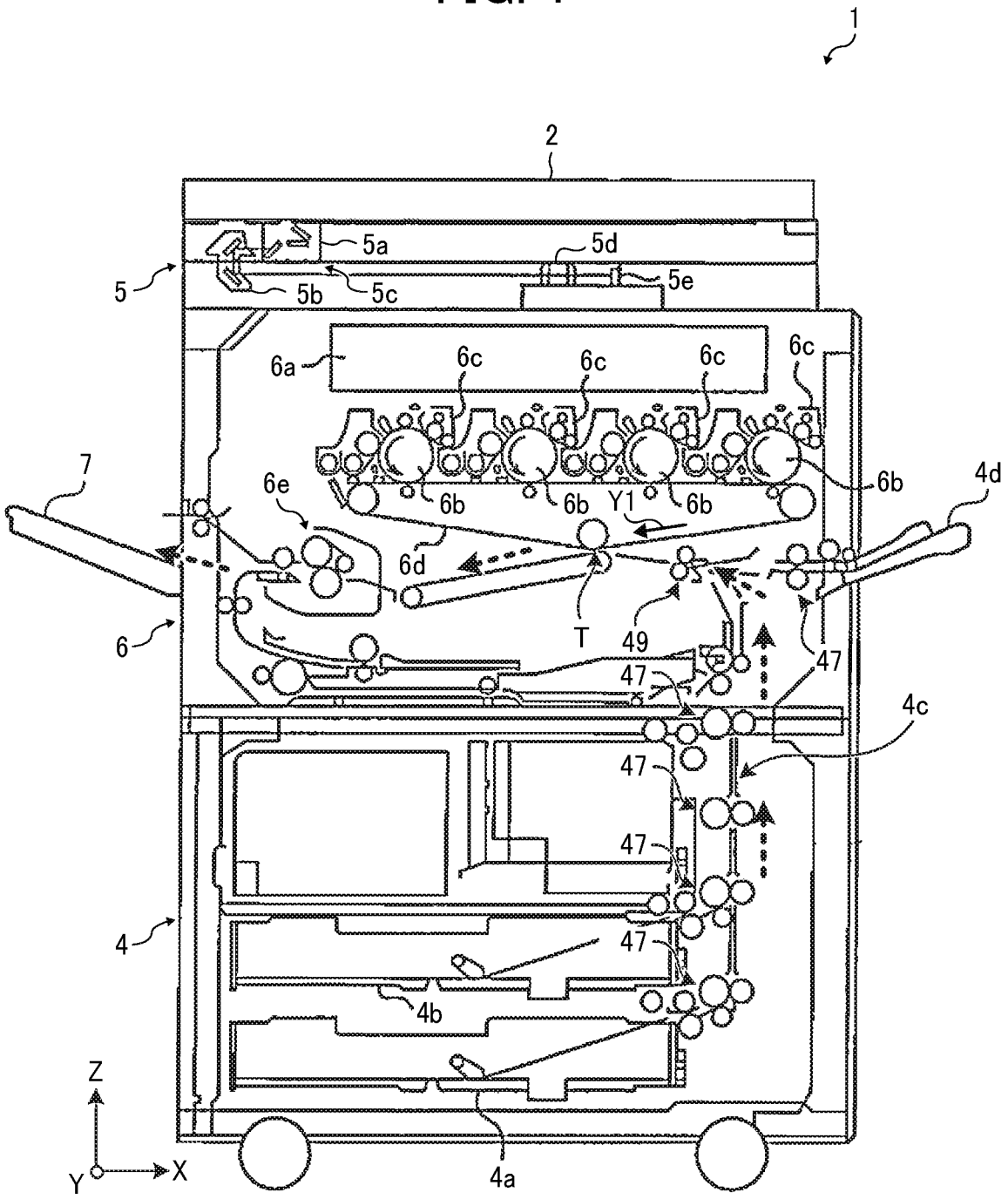
FIG. 1 is a schematic view of an image forming apparatus according to an embodiment of this disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

According to an aspect of this disclosure, a roller face of a roller used to measure the thickness of a sheet has a plurality of recesses (such as slits or grooves). Each recess can be a slit or groove extending parallel to the axis of rotation of the roller. In the embodiment described below, three recesses are spaced evenly in the direction of rotation of the roller to divide the circumference of the roller into three sections. The recesses are different in depth from each other. The depth of each of the recesses is greater than thickness of sheets usable in an image forming apparatus and greater than an eccentricity component of the roller. As the roller rotates, the slit reaches a detection position, and a sensor outputs a distinctive value out of a predetermined value or range. In the present embodiment, the rotation phase of the roller is identified based on the distinctive value.

Initially, descriptions are given below of an image forming apparatus according to the present embodiment with reference to FIG. 1. Note that the coordinate system indicated by an x-axis, a y-axis, and a z-axis is common to the drawings.

An image forming apparatus 1 according to the present embodiment is, for example, a multifunction peripheral (MFP) usable as a printer, a facsimile machine, a scanner, and a copier. The image forming apparatus 1 includes a document table 2, an image reading unit 5, a sheet feeder 4, and an image forming unit 6 (an image forming device).

The sheet feeder 4 feeds sheets into the image forming apparatus 1. The sheet feeder 4 includes trays 4*a* and 4*b* to contain different size sheets. The image forming apparatus 1 further includes conveyance rollers disposed along a conveyance path 4*c*, to convey the sheets from the tray 4*a* or 4*b* to the image forming unit 6. The sheet feeder 4 can further include a bypass sheet feeding tray 4*d* and a bypass feed path to convey sheets from the bypass sheet feeding tray 4*d* to the image forming unit 6.

Along the conveyance path 4*c*, a plurality of roller assemblies 47 is disposed upstream from the image forming unit 6 in the direction of conveyance of the sheet (hereinafter "sheet conveyance direction"). The roller assembly 47 is either a roller pair or a group of rollers and constructed of at least two rollers to clamp and convey the sheet. Alternatively, the roller assembly can include a plate of a guide rail and one roller disposed opposite to each other, to convey the sheet held therebetween as the roller rotates.

The image forming apparatus 1 further includes a registration roller pair 49 to adjust the timing of conveyance of the sheet to form the image at a predetermined position on the sheet.

A document table 2 is rotatable between an open position and a close position relative to the image reading unit 5 and presses a document sheet against a glass plate of the image reading unit 5.

The image reading unit 5 reads the document and converts the content of the document into image data. The image reading unit 5 includes an optical scanning system 5*c*, an image forming lens 5*d*, and an imaging device 5*e*. The optical scanning system 5*c* includes a first carriage 5*a*, on which a light source and a mirror are mounted, and a second carriage 5*b*, on which a mirror is mounted. The light source mounted on the first carriage 5*a* irradiates, with light, the document sheet placed on the glass plate and the light is reflected from the document sheet. The light reflected from the document sheet is further reflected by the mirrors mounted on the first and second carriages 5*a* and 5*b*, focused by the image forming lens 5*d* into an image, and read by the imaging device 5*e*.

The image forming unit 6 forms an image on the sheet fed by the sheet feeder 4. The image forming unit 6 includes an exposure device 6*a* and further includes a photoconductor drum 6*b* and a developing device 6*c* for each of cyan, magenta, yellow, and black. The image forming unit 6 further includes a transfer belt 6*d* and a fixing device 6*e*. In copying, the exposure device 6*a* exposes the photoconductor drum 6*b* according to the image read by the imaging device 5*e* to form a latent image of the read image on the photoconductor drum 6*b*. The developing device 6*c* supplies toner to the photoconductor drum 6*b* to develop the latent image into a toner image. The toner image is then primarily transferred from the photoconductor drum 6*b* onto the transfer belt 6*d*. The transfer belt 6*d* rotates in the direction indicated by arrow Y1 and conveys the toner image primarily transferred to a point T. At the point T, the toner image is secondarily transferred from the transfer belt 6*d* onto the sheet fed from the sheet feeder 4. The sheet onto which the toner image is transferred is conveyed to the fixing device 6*e*. The fixing device 6*e* heats the sheet to fix the transferred toner image on the sheet. The sheet on which the image is thus formed is discharged from the apparatus onto a tray 7.

Figure 2B:
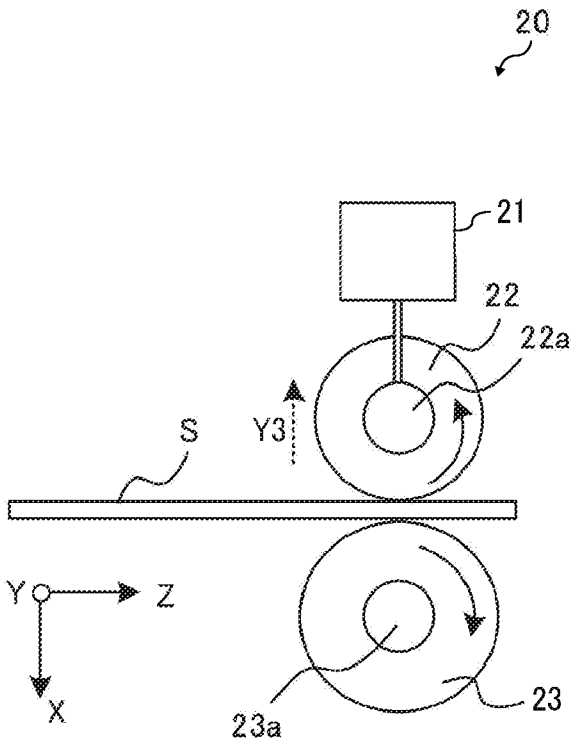
FIGS. 2A and 2B are side views of a comparative mechanism to detect a thickness of a sheet.
Figure 2A:
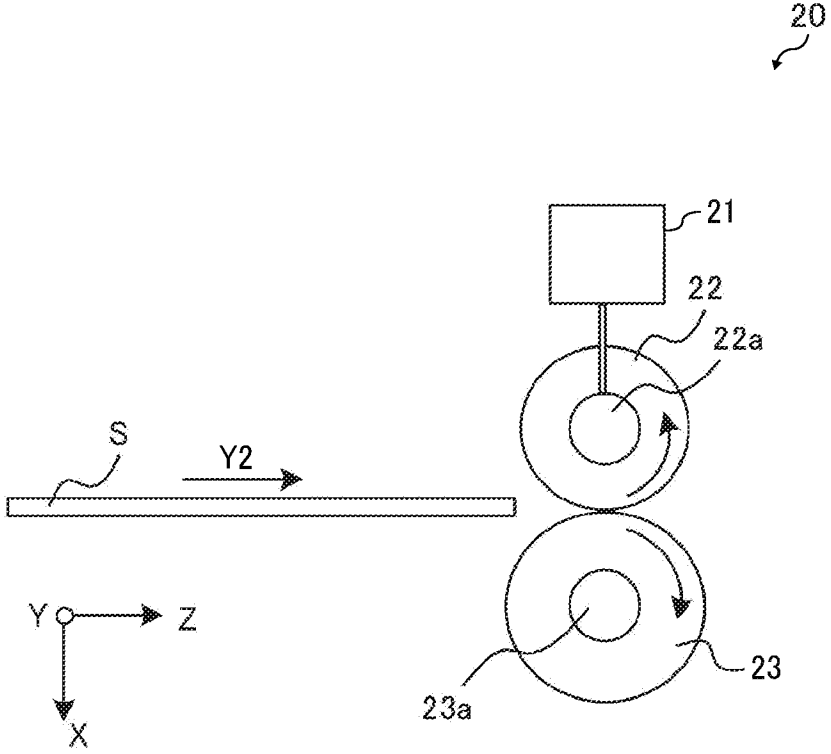

Before describing detection of sheet thickness according to the present embodiment, a basic technique is described with reference to FIGS. 2A, 2B, and 3. FIGS. 2A and 2B illustrate a thickness detector 20 to detect the sheet thickness, as a comparative example. For example, at least one of the roller assemblies 47 illustrated in FIG. 1 is provided with such a thickness detector. The thickness detector 20 is disposed upstream from the section in which an image is transferred onto the sheet and fixed on the sheet in the sheet conveyance direction. That is, the thickness detector 20 is disposed upstream from the point T at which the image is secondarily transferred onto the sheet and the fixing device 6*e* in the sheet conveyance direction.

The thickness detector 20 includes a sensor 21 and a roller pair constructed of a driven roller 22, and a driving roller 23. Each of the driven roller 22 and the driving roller 23 has an axis of rotation parallel to a Y-axis. Accordingly, the driven roller 22 and the driving roller 23 rotate on an X-Z plane. More specifically, the driving roller 23 rotates centering on (and together with) a shaft 23*a*. In FIGS. 2A and 2B, the driving roller 23 rotates clockwise (to the right) powered by a motor. The driving roller 23 keeps rotating at the same position with the shaft 23*a* rotatably supported at a fixed position. The driven roller 22 rotates counterclockwise (to the left) in FIGS. 2A and 2B, centering on (and together with) a shaft 22*a*. The driven roller 22 rotates, directly powered by the driving roller 23 in a state in contact with the driving roller 23 as illustrated in FIG. 2A. In a state in which a sheet S is held therebetween, the driven roller 22 rotates, indirectly powered by the driving roller 23 as illustrated in FIG. 2B, via the sheet S, and the sheet S is conveyed in the direction indicated by arrow Y2.

The shaft 22*a* of the driven roller 22 is movable in the direction of thickness of the sheet S, indicated by arrow Y3 in FIG. 2B. In FIG. 2A, the sheet S is not held between the roller pair including the driven roller 22 and the driving roller 23. This is a state hereinafter referred to as "state without sheet". As the sheet S is held therebetween (hereinafter referred to as "state with sheet"), the driven roller 22 together with the shaft 22*a* moves in the direction indicated by broken arrow Y3 in FIG. 2B. From the state with sheet as illustrated in FIG. 2B, as the sheet S is conveyed further and exits the driven roller 22 and the driving roller 23, the driven roller 22 moves in the direction opposite the direction indicated by broken arrow Y3. Thus, the driving roller 23 conveys the sheet S without changing the position thereof, while the driven roller 22 changes the position thereof in the direction perpendicular to the sheet conveyance direction, corresponding to the sheet thickness.

The sensor 21 detects, for example, the distance to the roller face of the driven roller 22 or the position of the shaft 22*a*, to detect the position of the driven roller 22. In the present embodiment, based on the output value from the sensor 21, a controller 42 (illustrated in FIGS. 4A and 4B) detects the amount of change in the distance to the roller face (displacement of the roller face) or the displacement of the shaft 22*a* between the state without sheet and the state with sheet, thereby detecting the thickness of the sheet.

Examples of the sensor 21 include a lever-type encoder, a magnetic linear sensor, an optical range finder (an optical distance sensor), an ultrasonic range finder, and a linear micro displacement sensor. In a case of a lever-type encoder, a lever is set in contact with the shaft 22*a*, and an encoder quantitatively detects the displacement of the lever as the shaft 22*a* moves. Other sensors also detect movement of the roller face or the shaft 22*a* either magnetically or optically to quantitatively detect the displacement.

Figure 3:
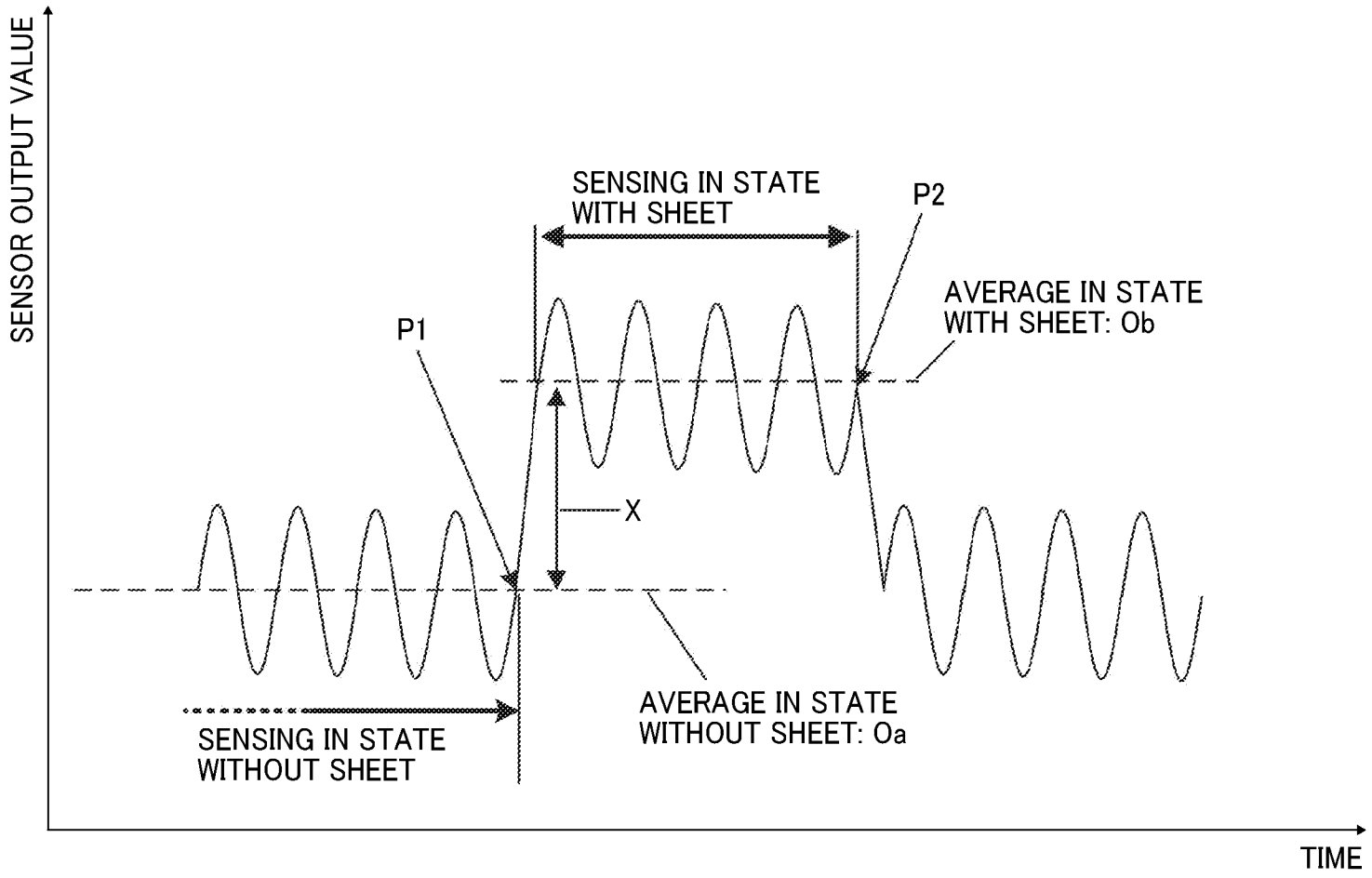
FIG. 3 is a graph illustrating an example output waveform of a sensor according to an embodiment.

FIG. 3 is a graph schematically illustrating the output value of the sensor 21 when the sheet is held in the roller pair and when the sheet is not. In FIG. 3, at a point P1, the sheet enters the roller pair, and the state with sheet starts. At a point P2, the sheet exits the roller pair, and the state of the roller pair returns to the state without sheet. In the description above with reference to FIGS. 2A and 2B, the sensor 21 detects the position of the driven roller 22 when the sheet is held in the roller pair and when the sheet is not therein, to detect the thickness of the sheet. In practice, however, the output value from the sensor 21 includes a component of roller eccentricity as represented by wavy lines in FIG. 3.

0005 In detecting the position of the roller with the sensor, the value of eccentricity component is identical in the state with sheet and the state without sheet if the phase of the roller is consistent between the two states. In other words, if the position of the roller is detected in the two states with the rotation phase of the roller made consistent in the two states, the difference between the detected positions can be free of the eccentricity component and represent the thickness of the sheet. Providing the conveyance path with a mechanism to identify the rotation phase and set the rotation phase identical between the two states, however, increases the cost of the apparatus.

To remove the component of roller eccentricity in a situation where the rotation phase of the driven roller 22 is unknown, it is necessary to sample the sensor output value for one rotation of the driven roller 22 in each of the state without sheet and the state with sheet. The controller 90 calculates a difference X between an average Oa (average output value) in the state without sheet and an average Ob in the state with sheet. The difference X represents the thickness of the sheet. If the sensor output value is sampled for one rotation in the state with sheet, however, the sheet is inevitably conveyed by one rotation of the driven roller 22.

0006 Accordingly, in an image forming apparatus in which the conveyance path is relatively short, the following inconvenience can occur. The sheet reaches the image forming unit before the sheet thickness is obtained, and the sheet thickness is not obtained in time to be referred to in image forming operation. Additionally, in the image forming apparatus in which the conveyance path is relatively short, the sheet conveyed during the sampling of the sensor output value may interfere with a preceding sheet.

Figure 4A:
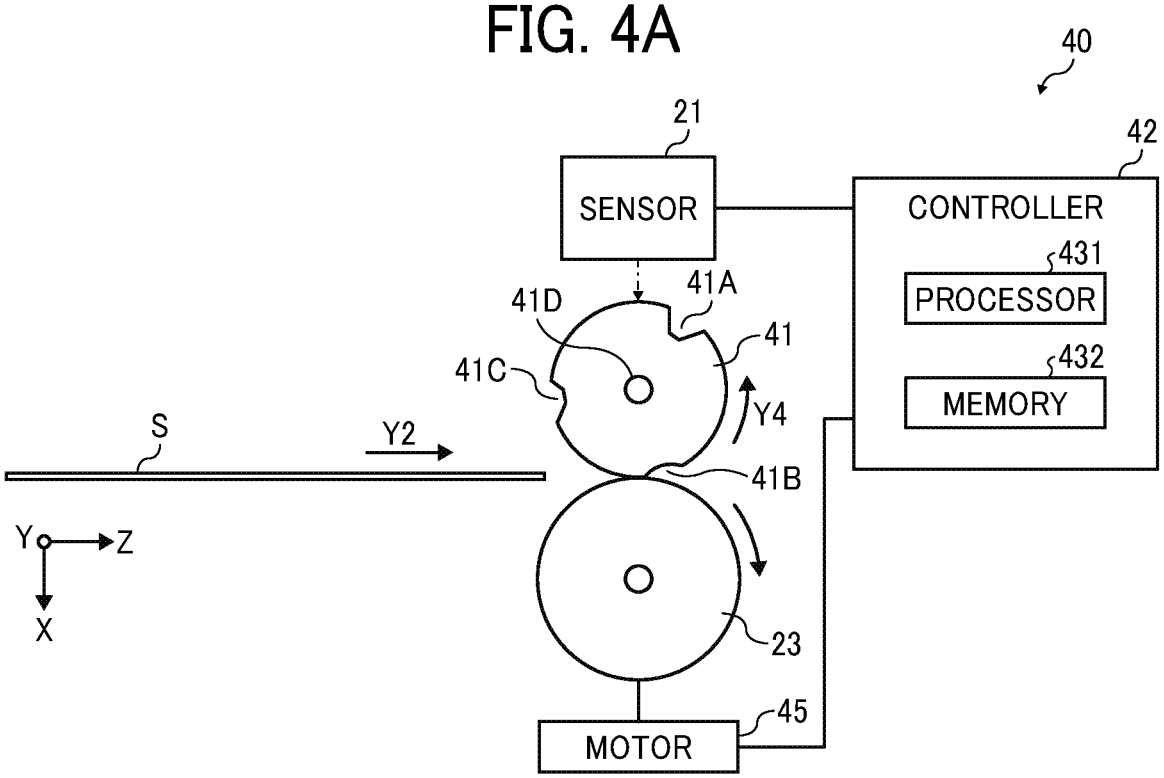
FIG. 4A is a diagram illustrating a hardware configuration of a thickness detector according to an embodiment.

In view of the foregoing, a thickness detector 40 according to the present embodiment includes a driven roller 41 having slits 41A, 41B, and 41C different in depth in the direction of diameter as illustrated in FIG. 4A. The driven roller 41 is a rotator having a plurality of marks different in shape and disposed at different positions on a face of the rotator in the direction of rotation of the rotator. The driving roller 23 is an opposing member disposed opposite the rotator. The opposing member is not limited to a roller but can be a guide plate or the like. At least one of the roller assemblies 47 illustrated in FIG. 1 includes the driven roller 41 and is provided with the sensor 21. FIG. 4A is a diagram illustrating a hardware configuration of the thickness detector 40. The driven roller 41 rotates centering on (and together with) a rotation shaft 41D in the direction indicated by arrow Y4 in FIG. 4A. The slits 41A, 41B, and 41C are different from each other in dimension in the radial direction of the driven roller 41. The slits 41A, 41B, and 41C are arranged at equal intervals in the direction of rotation of the driven roller 41. For example, in the driven roller 41, the slits 41A, 41B, and 41C are disposed to equally divide the circumference of the driven roller 41 into three sections. In the present embodiment, of the three recesses, the slit 41A is the deepest and the slit 41B is the shallowest. The depth of the slit 41C is between the depth of the slit 41A and that of the slit 41B. The depths of the slits 41A to 41C are greater than thicknesses of sheets to be fed in the image forming apparatus 1. That is, the change in the sensor output value caused by the sheet thickness is smaller than the change in the sensor output value caused by each of the slits 41A to 41C. Additionally, the slits 41A, 41B, and 41C are deep enough to change the sensor output value by an amount greater than the amount caused by the displacement by the eccentricity component of the driven roller 41.

Since the driven roller 41 has a plurality of slits 41A to 41C in the roller face, the sensor output values corresponding to the slits 41A to 41C can be used as marks to determine which the rotation phase of the driven roller 41 is detected by the sensor 21.

Figure 4B:
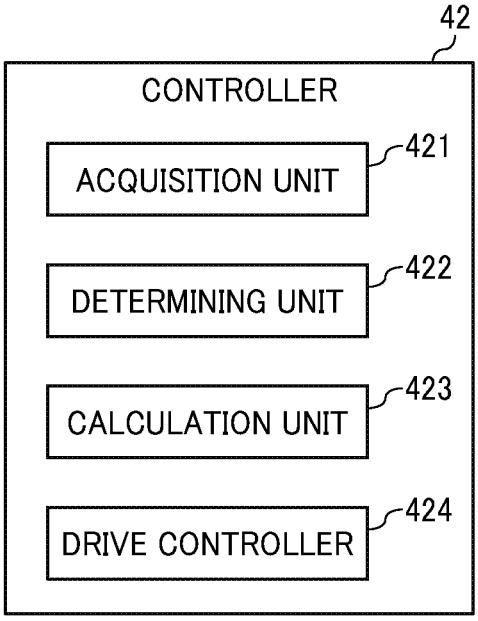
FIG. 4B is a block diagram illustrating a software configuration of a controller of the thickness detector illustrated in FIG. 4A.

Additionally, FIGS. 4A and 4B illustrate the controller 42 to obtain the output value from the sensor 21 to compute the thickness of the sheet S based on the output value. FIG. 4B is a block diagram illustrating a software configuration of the controller 42. As illustrated in FIG. 4B, the controller 42 includes an acquisition unit 421, a determining unit 422, a calculation unit 423, and a drive controller 424. These functional units are implemented by the hardware components such as a processor 431 and a memory 432 illustrated in FIG. 4A. For example, the processor 431 is a central processing unit (CPU), and the memory 432 is a volatile or nonvolatile memory to store data. In other words, as the processor 431 executes a program stored in the memory 432, the respective functions of the acquisition unit 421, the determining unit 422, the calculation unit 423, and the drive controller 424 illustrated in FIG. 4B are implemented. Alternatively, a part of the functional units can be implemented by an integrated circuit such as an application specific integrated circuit (ASIC).

The acquisition unit 421 acquires the output value from the sensor 21. Based on the output value from the sensor 21, the determining unit 422 determines whether the sheet S has reached one of the slits 41A to 41C. The calculation unit 423 calculates the thickness of the sheet S based on the output value from the sensor 21 and the result of determination made by the determining unit 422. Calculation by the calculation unit 423 is described in further detail later. The drive controller 424 controls turning on and off of the motor 45 and rotation speed of the motor 45 to control the rotation of the driving roller 23. The motor 45 is a drive source of the driving roller 23. According to an instruction from the drive controller 424, the motor 45 starts the driving roller 23, stops the driving roller 23, and switches the speed between low speed and high speed.

Note that the sensor 21, the controller 42, the motor 45, the driven roller 41, and the driving roller 23 illustrated in FIG. 4A and the software configuration illustrated in FIG. 4B together constitute the thickness detector 40 according to the present embodiment. The thickness detector 40 can be included in the roller assembly 47 of the image forming apparatus 1 described above.

Figure 5A:
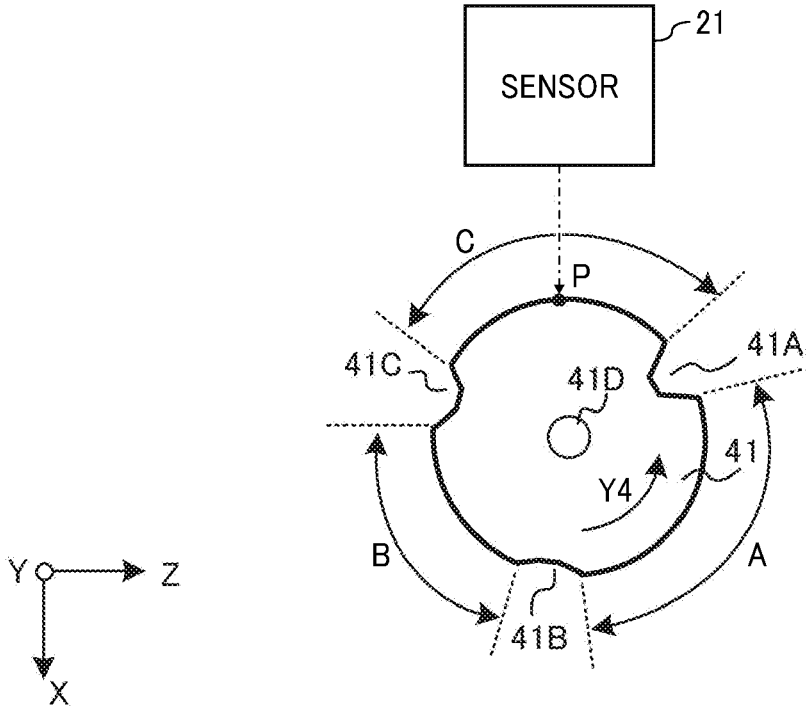
FIG. 5A illustrates a driven roller illustrated in FIG. 4A.
Figure 5B:
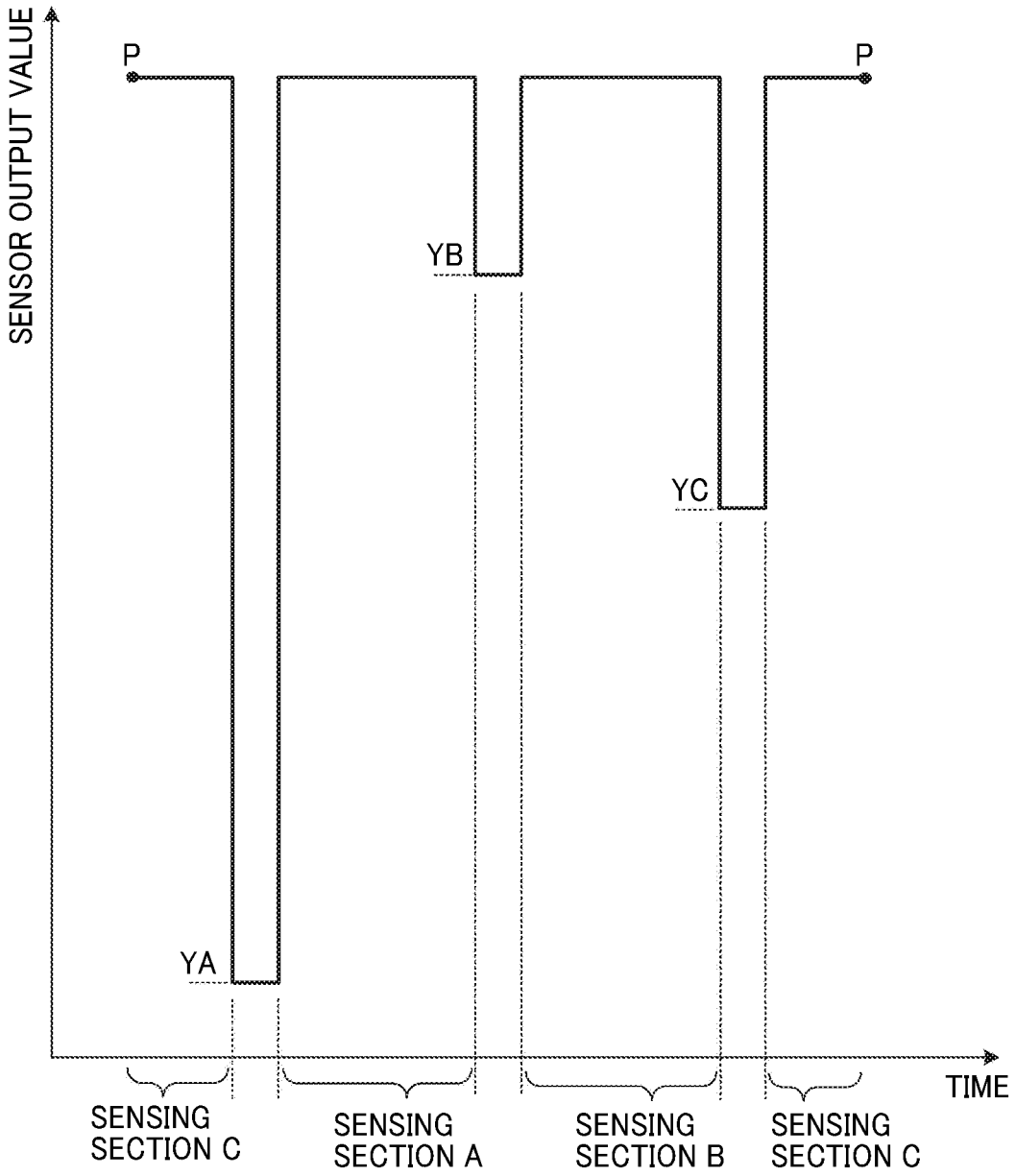
FIG. 5B is a graph of output values from the sensor of the thickness detector illustrated in FIG. 4A, in which values output when the sensor detects slits are emphasized.

FIG. 5A illustrates the driven roller 41 illustrated in FIG. 4A, and FIG. 5B illustrates the output values from the sensor 21 while the driven roller 41 makes one rotation. FIG. 5B is a graph schematically illustrating the output value of the sensor 21 while the sensor 21 reads position of the driven roller 41 over the entire circumference of the driven roller 41 that starts at a given point P and ends at the point P. In the example illustrated in FIG. 5B, the eccentricity component of the driven roller 41 is ignored for simplicity. Since the slits 41A, 41B, and 41C are different in depth from each other, the sensor output value at the slits 41A, 41B, and 41C are different from each other.

In the example illustrated in FIG. 5B, the sensor 21 outputs a value YA when detecting the slit 41A, a value YB when detecting the slit 41B, and a value YC when detecting the slit 41C. The values YA, YB, and YC are outstanding relative to the values output from the sensor 21 detecting the roller face without the recesses. In other words, even if the point at which the sensor 21 starts reading is unknown, the controller 42 can determine which of the slits 41A, 41B, and 41C the sensor 21 has detected based on the values YA, YB, and YC output therefrom. Note that, in a case where the output value of the sensor 21 represents the distance from the roller face, the sensor 21 outputs an outstanding value when the slit reaches the detection position of the sensor 21. In this case, the detection position of the sensor 21, which is fixed, is the detection position of the slit. Alternatively, in a case where the output value of the sensor 21 represents the position of the rotation shaft 41D, as the recessed portion (the slit) contacts the driving roller 23, the rotation shaft 41D moves significantly. Then, an outstanding output value is attained. In this case, the contact portion with the driving roller 23 is the position at which the slit is detected.

When the controller 42 identifies which of the slits 41A, 41B, and 41C has detected, the controller 42 can identify the section that has been sensed and the section to be sensed next. In FIG. 5A, a section A extends between the slits 41A and 41B, a section B extends between the slits 41B and 41C, and a section C extends between the slits 41A and 41C. When the output value from the sensor 21 becomes the value YA, the controller 42 determines that the section C has been sensed until then and the section A is to be sensed next. Similarly, when the output value from the sensor 21 becomes the value YB, the controller 42 determines that the section A has been sensed until then and the section B is to be sensed next. When the output value from the sensor 21 becomes the value YC, the controller 42 determines that the section B has been sensed until then and the section C is to be sensed next.

Thus, the slits 41A, 41B, and 41C serve as marks (distinctive portions) for determining the rotation phase of the driven roller 41. In the present embodiment, the number of slits is three, and the rotation phase is sectioned into three. Increasing the number of slits is advantageous in that the rotation phase can be identified more finely.

Figure 6:
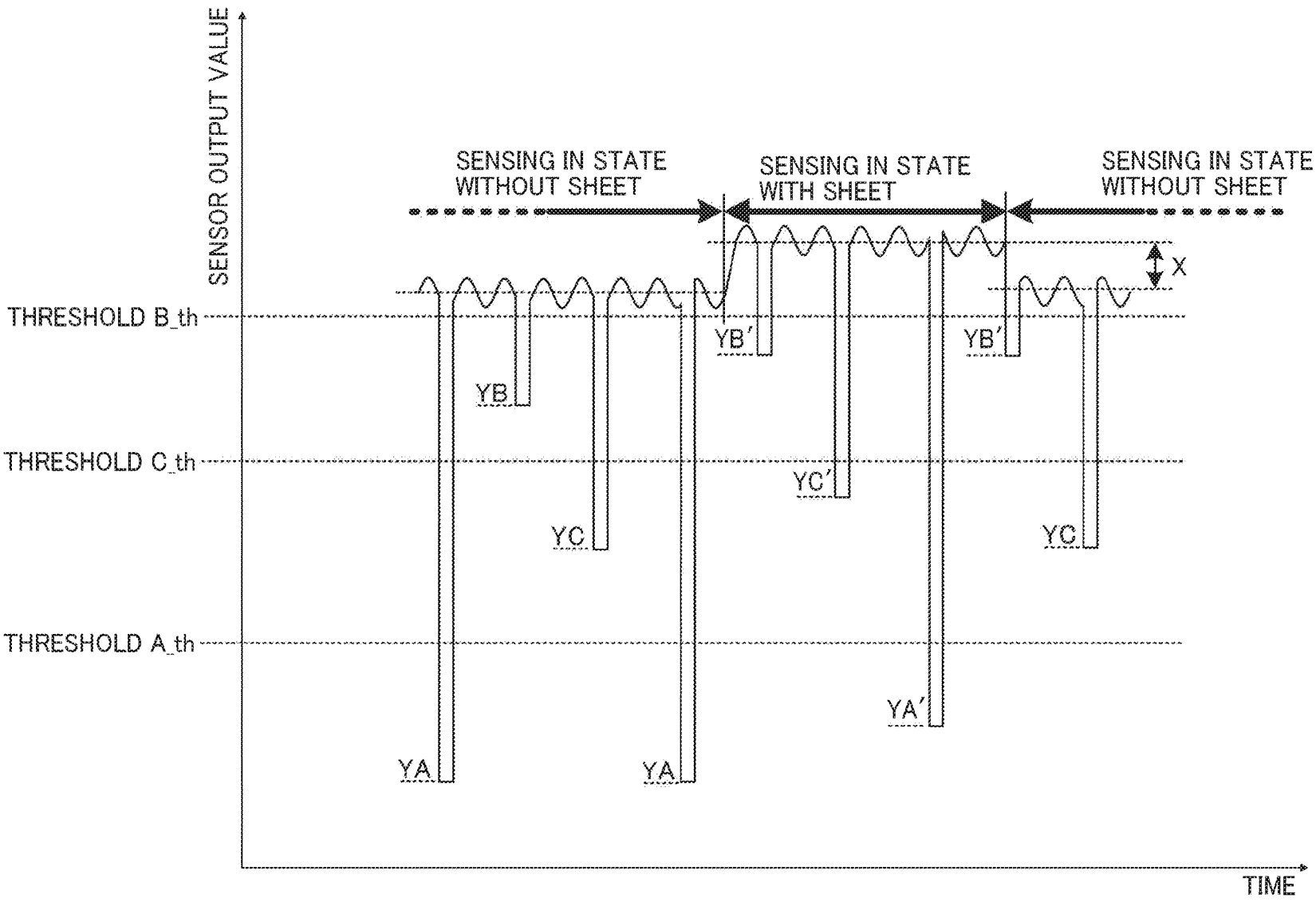
FIG. 6 is a graph illustrating a detailed example of a sensor output waveform in the structure illustrated in FIGS. 4A and 4B.

FIG. 6 is a graph illustrating a detailed example of the sensor output value in the structure illustrated in FIGS. 4A and 4B. Note that, differently from FIG. 5B, the eccentricity component of the driven roller 41 is illustrated as waves in FIG. 6. When the sheet is held between the roller pair, the sensor output values corresponding to the slits 41A, 41B, and 41C change by the thickness of the sheet. In FIG. 6, the value YA corresponding to the slit 41A becomes a value YA' increased by the thickness of the sheet. Similarly, the value YB corresponding to the slit 41B becomes a value YB' and the value YC corresponding to the slit 41C becomes a value YC'.

In the structure in which the change in the sensor output value caused by each of the slits 41A, 41B, and 41C (difference with the roller face without the slit) is greater than the change in the sensor output value caused by the sheet thickness, the slits 41A, 41B, and 41C attain outstanding sensor output values. Generally, sheets used in an image forming apparatus have a thickness equal to or smaller than 0.3 mm. For example, the slit 41A is 5 mm in depth, the slit 41B is 3 mm in depth, and the slit 41C is 4 mm in depth so that the depths thereof change by 1 mm. In this structure, the position of the roller can be determined based on the sensor output waveform even when the sheet is held in the roller pair.

The controller 42 determines whether the sensor 21 has detected any one of the slits 41A, 41B, and 41C using thresholds A_th, B_th, and C_th in FIG. 6. With the thresholds A_th, B_th, and C_th, the controller 42 can determine which of the slits 41A, 41B, and 41C the sensor 21 has detected, regardless of the presence or absence of the sheet. When the sensor output value is lower than the threshold A_th, the controller 42 determines that the sensor 21 has detected the slit 41A. When the sensor output value is in a range from the threshold A_th to the threshold C_th, the controller 42 determines that the sensor 21 has detected the slit 41C. When the sensor output value is in a range from the threshold C_th to the threshold B_th, the controller 42 determines that the sensor 21 has detected the slit 41B. Further, when the sensor output value is above the threshold B_th, the controller 42 determines that the section detected is one of sections without the slits 41A to 41C.

Figure 7:
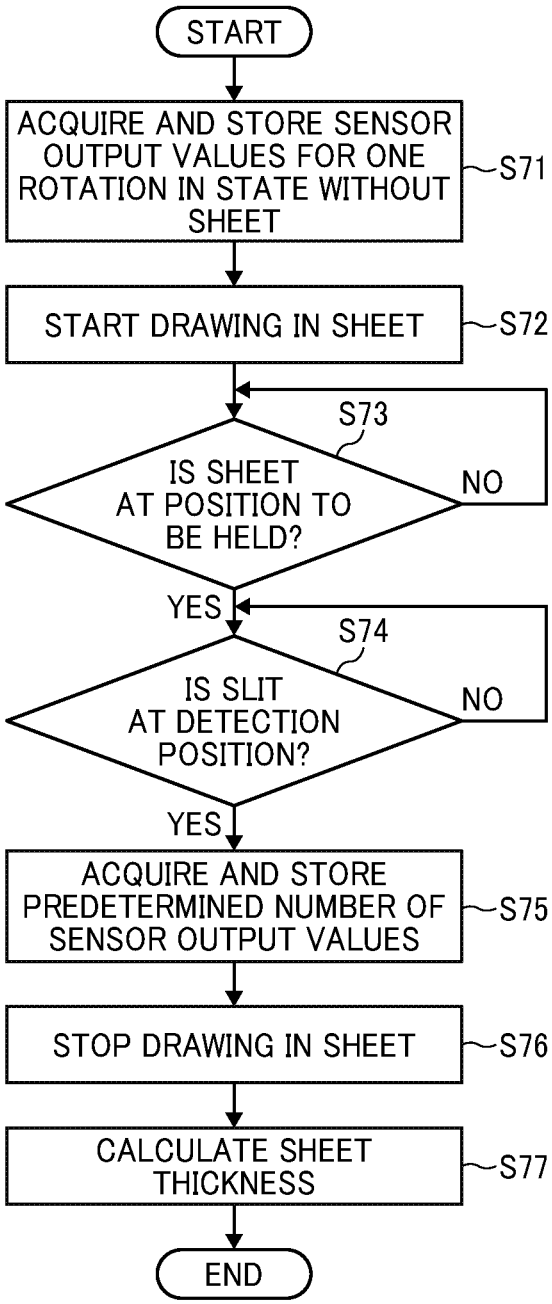
FIG. 7 is a flowchart illustrating an example of processing to detect sheet thickness according to an embodiment.

FIG. 7 is a flowchart illustrating an example of processing to detect sheet thickness according to the present embodiment. At S71, the acquisition unit 421 of the controller 42 acquires the output values (i.e., first output values) from the sensor 21 for one rotation of the driven roller 41 in the state without sheet. At S71, the drive controller 424 activates the motor 45 to rotate the driving roller 23. In conjunction with the rotation of the driving roller 23, the driven roller 41 rotates. The controller 42 turns the sensor 21 on. Then, the acquisition unit 421 acquires, from the sensor 21, the output values for one rotation of the driven roller 41. The values acquired at S71 are data sampled for one rotation and include the values corresponding to the slits 41A, 41B, and 41C, for example, in the period "SENSING IN STATE WITHOUT SHEET" in FIG. 6. The values acquired are temporality stored, for exampled, in the memory 432. In the present embodiment, Step S71 is executed, for example, each time an image forming job is performed. Alternatively, Step S71 can be executed in predetermined cycles without being synchronized with the job. Alternatively, Step S71 can be executed at the power on of the image forming apparatus 1 and recovery from a sleep mode. The timing to execute Step S71 can be set preliminarily, for example, before shipment of the image forming apparatus 1. The values acquired at Step S71 are numerals converted from the waveform in, for example, the period "SENSING IN STATE WITHOUT SHEET" in FIG. 6 and include the eccentricity component.

After rotating the driven roller 41 by one rotation in the state without sheet, at S72, the controller 42 activates a pickup roller to draw the sheet into the body of the image forming apparatus 1. At S73, the determining unit 422 determines whether or not the sheet drawn into has reached the position to be held by the driven roller 41 and the driving roller 23. Specifically, the determining unit 422 determines whether or not the output value from the sensor 21 exceeds a specified value to determine whether the sheet is held. Alternatively, the determination can be made based on image data taken by a photosensor.

When the determining unit 422 determines that the sheet has reached the position to be held (Yes at S73), at S74, the determining unit 422 determines whether one of the slits 42A, 41B, and 41C is at the detection position. Specifically, when the sensor output value is smaller than the threshold B_th illustrated in FIG. 6, the determining unit 422 determines that one of the slits 42A, 41B, and 41C is at the detection position. When the sensor output value is lower than the threshold A_th, the determining unit 422 determines that the slit 41A is positioned at the detection position. When the sensor output value is equal to or greater than the threshold A_th and lower than the threshold C_th, the determining unit 422 determines that the slit 41C is positioned at the detection position. When the sensor output value is equal to or greater than the threshold C_th and lower than the threshold B_th, the determining unit 422 determines that the slit 41B is positioned at the detection position. Thus, the determining unit 422 can identify which of the slits 41A, 41B, and 41C is positioned at the detection position.

After the slit is identified, at S75, the acquisition unit 421 acquires (samples) a predetermined number of output values (i.e., second output values) from the sensor 21. The data values acquired Step at S75 are sensor output values in the state in which the sheet is held in the roller pair, and the number of data values acquired is set to a number sufficient to calculate the sheet thickness. Here, the number of output values of the sensor 21 to be acquired is predetermined. Alternatively, to acquire a sufficient number of output values, the amount (distance or angle) by which the driven roller 41 has rotated from when the slit is positioned at the detection position can be predetermined. Yet alternatively, a length of time from when the slit is detected can be predetermined. Further, the predetermined number of output values (or amount of rotation or time) is set, for example, to an amount acquired until the subsequent slit reaches the detection position, so that the driven roller 41 does not make a complete rotation during the acquisition.

At S76, the drive controller 424 stops the motor 45 to stop drawing in the sheet. In a case where the output values are acquired until the subsequent slit reaches the detection position at S75, the amount of rotation of the driven roller 41 is limited, at least, to an amount smaller than one rotation thereof. In a roller in which the slits 41A to 41C are evenly spaced, the amount of rotation is one third of rotation.

At S77, the calculation unit 423 calculates the thickness of the sheet using the sensor output values acquired at S71 and S75. From the data values for one rotation of the driven roller 41 acquired at S71, the calculation unit 423 identifies the slit identical to the slit identified at S74 and extracts an identical number of sampled data values to the number of data values acquired at S75. In this processing, from the data values acquired for one rotation of the roller acquired at S71, the output values identical in phases to the output values acquired at S75 are extracted. Subsequently, the calculation unit 423 calculates an average of the output values extracted from the data values acquired in the state without sheet at S71, calculates an average of the output values acquired in the state with sheet at S75, and calculates the difference between these averages. In this manner, the calculation unit 423 can acquire the difference between the average values in the state with sheet and in the state without sheet with the phase made identical between the two states, remove the error caused by the eccentricity component of the driven roller 41, and then calculate the thickness of the sheet.

Based on the thickness of the sheet calculated, the controller 42 calculates, for example, a correction value for subsequent image formation. Then, the image forming unit 6 can perform preferable image formation on a subsequent sheet based on such a correction value.

Although the slits are formed in the roller face of the driven roller 41 in the present embodiment, alternatively, such marks (distinctive portions or shapes like slits) can be formed in a component that rotates together with the driven roller 41. For example, the component that rotates together with the driven roller 41 is the rotation shaft 41D. In this case, as the sensor 21 detects the mark (a distinctive portion or shape) on the surface of the rotation shaft 41D, the controller 42 identifies the rotation phase of the rotation shaft 41D based on the detected mark.

Although the number of the slits is three in the structure illustrated in FIGS. 4A and 5A, the number of the slits is not limited as long as the number is equal to or greater than two. Although the slits are evenly spaced in the direction of rotation in the structure illustrated in FIGS. 4A and 5A, the spaces therebetween are not necessarily even.

Figure 8:
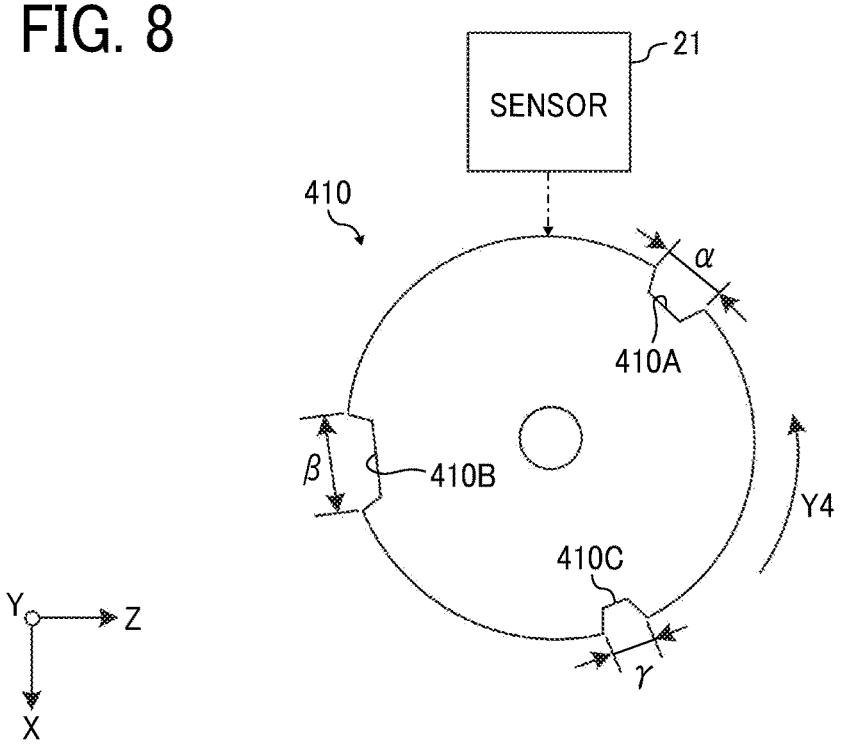
FIG. 8 is a schematic end-on axial view of a roller according to a modification.

Although a plurality of slits different in depths is formed in the roller face in the above-described embodiment, alternatively, a plurality of slits same in depth but different in length in the direction of rotation can be formed as illustrated in FIG. 8. In the example illustrated in FIG. 8, a driven roller 410 has slits 410A, 410B, and 410C having circumferential lengths $\alpha$, $\beta$, and $\gamma$, respectively, where $\alpha$ is greater than $\gamma$ and smaller than $\beta$ ($\beta>\alpha>\gamma$). In this case, the length of the slit 410A, 410B, or 410C in the direction of rotation can be obtained based on the rotation speed of the driven roller 410 and the time starting when the slit reaches the detection position of the sensor 21 to when the slit exits the detection position. As the length in the direction of rotation is obtained, which of the slits 410A, 410B, and 410C has passed by the detection position can be identified. Therefore, the driven roller 410 having the slits 410A, 410B, and 410C illustrated in FIG. 8 can attain the effects similar to those attained in the embodiment described above. Note that, although the depths of the slits are identical in FIG. 8, alternatively, the depths can be different from each other.

Figure 9:
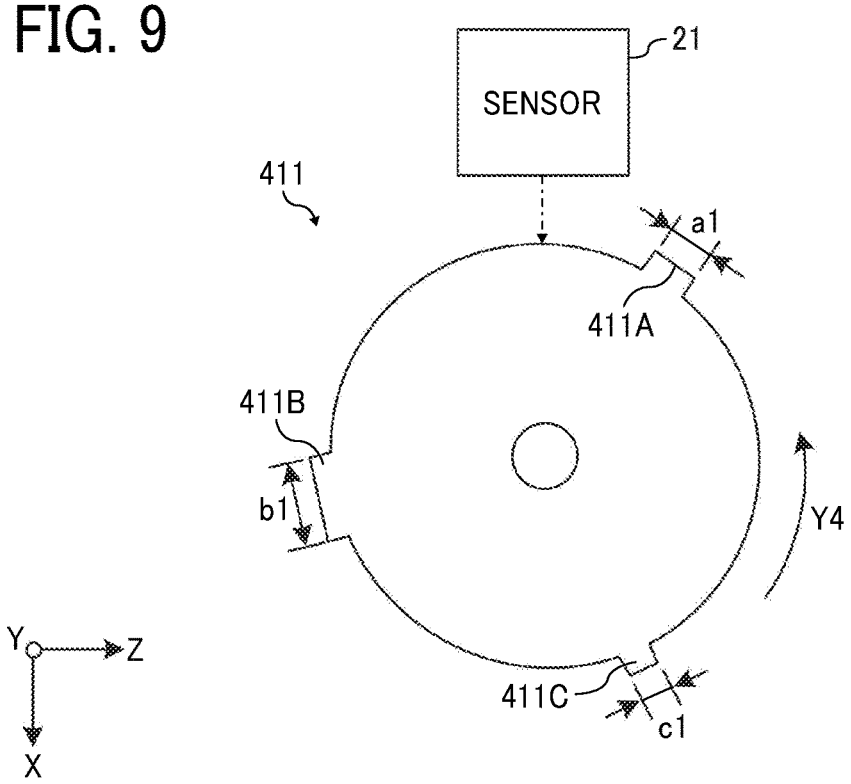
FIG. 9 is a schematic end-on axial view of a roller according to another modification.

Although the slits (recesses) are formed in the driven roller in the description above, alternatively, similar effects can be attained with a roller having projections as illustrated in FIG. 9. In the example illustrated in FIG. 9, a driven roller 411 has three projections 411A, 411B, and 411C having widths a1, b1, and c1, respectively, where a1 is smaller than b1 and greater than c1 (b1>a1>c1). The three projections 411A, 411B, and 411C are distinctive portions (distinctive shapes) to identify the rotation phase of the driven roller 411.

This structure can attain effects similar to those attained in the description above. Although the projections 411A, 411B, and 411C illustrated in FIG. 9 are different in length in the direction of rotation of the driven roller 411, alternatively, the driven roller 411 can have projections different in height or different in both of height and width. Yet alternatively, the distinctive portions can be a combination of at least one projection and at least one slit.

Figure 10:
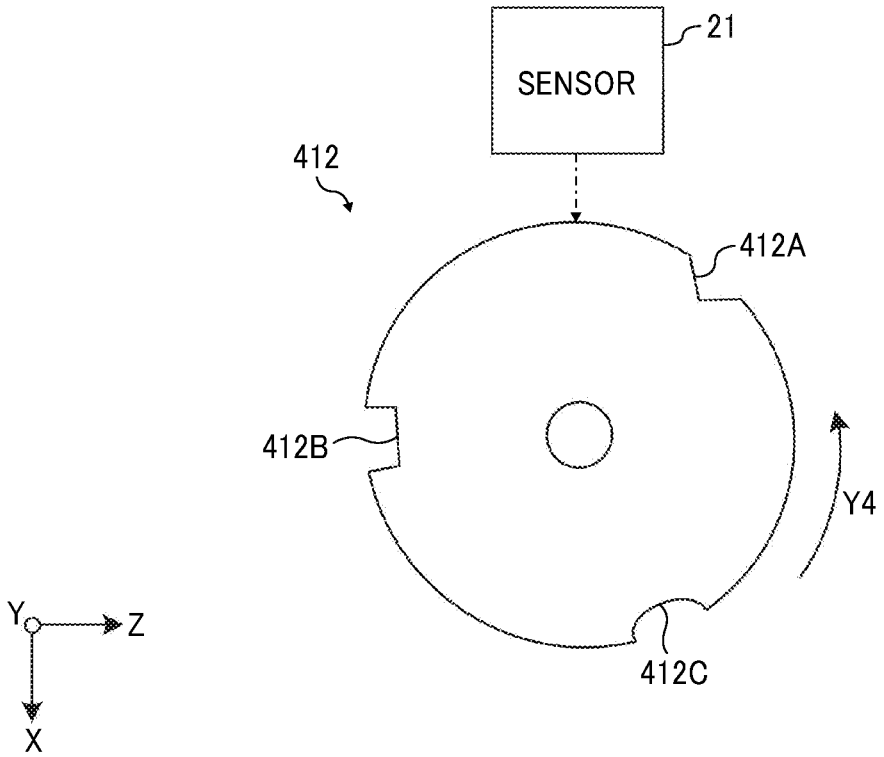
FIG. 10 is a schematic end-on axial view of a roller according to another modification.

Further, in the example illustrated in FIG. 10, a driven roller 412 has, as the distinctive portions (distinctive shapes), a triangular slit 412A, a tetragonal slit 412B, and a circular slit 412C. Alternatively, the distinctive portions of the roller can be a combination of a triangular projection, a tetragonal projection, and a circular projection. As long as the sensor 21 can detect the difference of the shape of the distinctive portion, any shape is applicable.

In the above-described embodiment, the sensor 21 detects the displacement of the driven roller 41 including the distinctive portions. In another embodiment, the driven roller 41 including the distinctive portions is designed to rotate at an identical position, the driving roller 23 is movable in the thickness direction of the sheet, and the sensor 21 detects the amount of displacement of the driving roller 23.

As described above, according to an aspect of this disclosure, a face of a roller includes distinctive portions different in shape to enable removal of eccentric error of the roller. Accordingly, accuracy in detection of sheet thickness improves. Further, since the mechanism to identify the rotation phase is not necessary, the cost of the apparatus can be reduced.

Although the description above concerns an image forming apparatus employing electrophotography, aspects of this disclosure are applicable to an inkjet printer and an apparatus to perform processing such as liquid discharge onto a sheet.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

What is claimed is:

1. A thickness detector comprising:

a roller assembly including:

a rotator having a plurality of marks different in shape and disposed at different positions on a face of the rotator in a direction of rotation of the rotator; and an opposing member disposed opposite the rotator, to convey a sheet held in the roller assembly together with the rotator;

a detector to detect and output an amount of displacement of one of the rotator and the opposing member in a direction of thickness of the sheet; and a controller including:

a first acquisition unit configured to acquire first output values for one rotation of the rotator from the detector, the first output values being output in a state in which the sheet is not held in the roller assembly;

a determining unit configured to determine, based on a value output from the detector, whether the detector has detected one of the plurality of marks of the rotator in a state in which the sheet is held in the roller assembly;

a second acquisition unit configured to acquire, from the detector, a predetermined number of second output values output after detection of the one of the plurality of marks; and a calculation unit configured to extract, from the first output values for one rotation of the rotator, output values corresponding to the predetermined number of second output values acquired by the second acquisition unit, based on the value output corresponding to detection of the one of the plurality of marks, the calculation unit further configured to calculate a thickness of the sheet based on the second output values and the extracted first output values.

2. The thickness detector according to claim 1, wherein the plurality of marks is a plurality of recesses in the face of the rotator, the plurality of recesses having different depths from each other, and wherein the determining unit is configured to determine which of the plurality of recesses has detected based on a difference in the depths of the plurality of recesses.

3. The thickness detector according to claim 2, wherein the difference in the depths of the plurality of recesses are greater than the thickness of the sheet.

4. The thickness detector according to claim 2, wherein the depths of the plurality of recesses are greater than an eccentricity component of the face of the rotator.

5. The thickness detector according to claim 1, wherein the plurality of marks is a plurality of recesses in the face of the rotator, the plurality of recesses having different lengths, from each other, in the direction of rotation of the rotator, and wherein the determining unit is configured to determine which of the plurality of recesses has detected based on a difference in the lengths of the plurality of recesses in the direction of rotation of the rotator.

6. The thickness detector according to claim 1, wherein the plurality of marks is a plurality of projections on the face of the rotator, the plurality of projections different, from each other, in at least one of height from the face of the rotator and length in the direction of rotation of the rotator, and wherein the determining unit is configured to determine which of the plurality of projections has detected based on a difference in the at least one of height from the face of the rotator and length in the direction of rotation of the rotator.

7. The thickness detector according to claim 1, wherein the plurality of marks is evenly spaced in the direction of rotation of the rotator, and wherein the second acquisition unit is configured to acquire, from the detector, the second output values until the detector detects another one of the plurality of marks.

8. An image forming apparatus comprising:

an image forming device to form an image on a sheet; and the thickness detector according to claim 1, wherein the roller assembly of the thickness detector is disposed upstream from the image forming device in a direction of conveyance of the sheet.

* * * * *